United States Patent [19]

Johnson

[11] 4,068,649

[45] Jan. 17, 1978

[54] FREE STANDING FIREPLACE STOVE

[75] Inventor: William R. Johnson, Santa Cruz, Calif.

[73] Assignee: Peerless Portable Metal Building, Santa Cruz, Calif.

[21] Appl. No.: 685,453

[22] Filed: May 12, 1976

[51] Int. Cl.[2] ..... F24B 1/18

[52] U.S. Cl. ..... 126/120; 126/143

[58] Field of Search ..... 126/56, 57, 120, 121, 126/137, 336, 143, 130, 131

[56] References Cited

U.S. PATENT DOCUMENTS

| | | | |
|---|---|---|---|
| 1,006,858 | 10/1911 | Lobach | 126/143 X |
| 2,375,318 | 5/1945 | Mudgett | 126/143 |
| 2,821,975 | 2/1958 | Thulman | 126/120 |
| 3,910,251 | 10/1975 | Andrew | 126/120 |
| 3,926,174 | 12/1975 | Bell | 126/121 |
| 3,970,067 | 7/1976 | Vaughn | 126/120 |
| 3,976,048 | 8/1976 | Ashman, Jr. | 126/143 |

*Primary Examiner*—Ronald C. Capossela
*Attorney, Agent, or Firm*—Robert G. Slick

[57] ABSTRACT

A free standing fireplace stove is provided wherein the combustion air passes under the bottom of the combustion chamber to keep the bottom of the fireplace unit cool. The fireplace is so well insulated that it may be installed on a rug without the use of a hearth.

5 Claims, 7 Drawing Figures

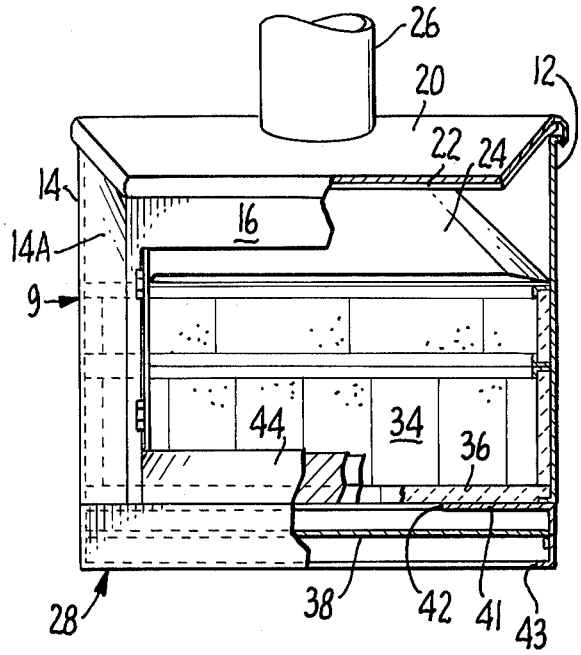
FIG. 5.
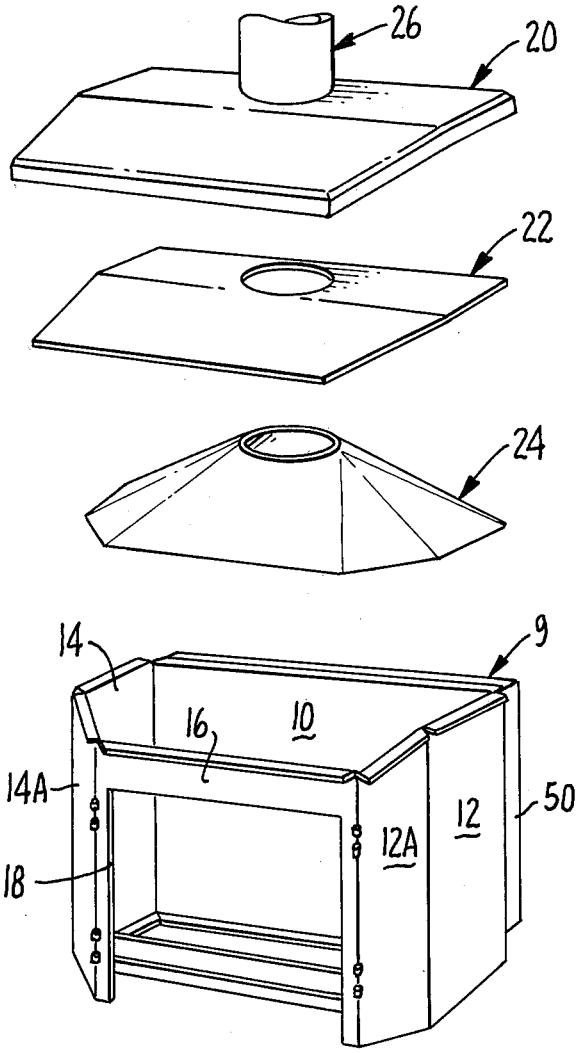
FIG. 6.
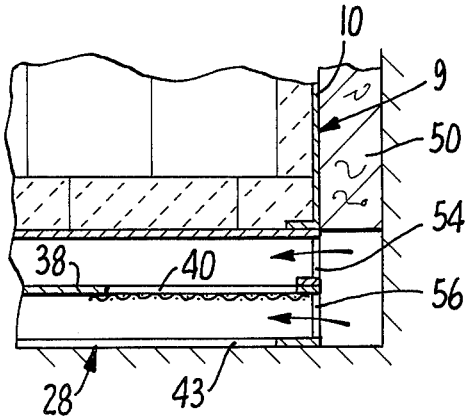
FIG. 7.
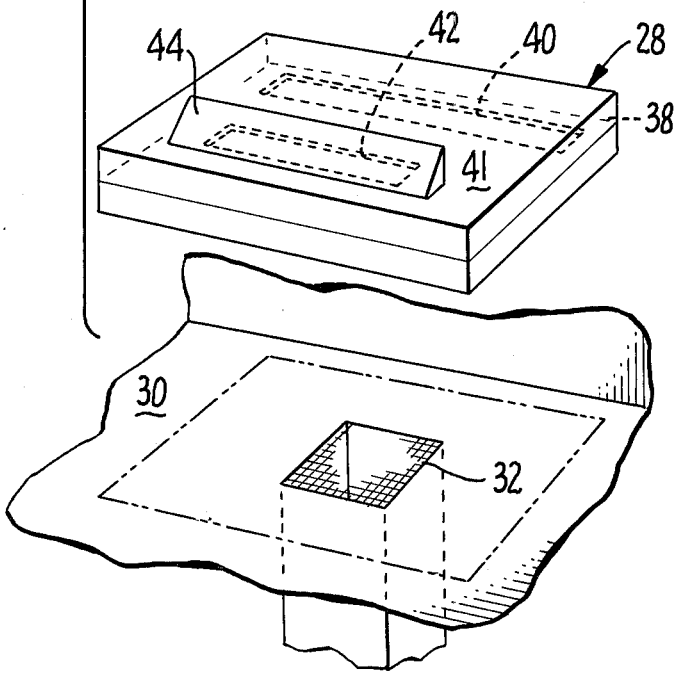

FREE STANDING FIREPLACE STOVE

SUMMARY OF THE INVENTION

A free standing fireplace stove is provided having a number of features not shown by any prior art structures.

Although various free standing fireplace stoves have been proposed in the past, they have ordinarily required an extensive installation and particularly they have required a fireproof hearth to protect the building in which they are erected. The fireplace stove of the present invention is so well insulated on the bottom that it can be installed in a building without a hearth and, in fact, can even be installed on a rug without requiring any means for protecting the rug.

Another deficiency of prior art structures is that there is a danger of fire when the stove is left unattended. The structure of the present invention preferably includes tight doors so that the stove does not present a fire hazard if left unattended.

The device of the present invention is particularly suitable for use in mobile homes since it can be installed directly on the floor and against the wall with no clearance required either at the wall or insulation required on the floor.

BRIEF DESCRIPTION OF THE DRAWINGS

In the drawings forming part of this application:

FIG. 5 is a front view of a stove embodying the present invention with certain parts in section.

FIG. 6 is an exploded view showing the various metal parts which are employed to make up the stove embodying the present invention.

FIG. 7 is a partial side view in section showing how the stove is installed in a permanent dwelling.

DESCRIPTION OF THE PREFERRED EMBODIMENTS

Figure 1:
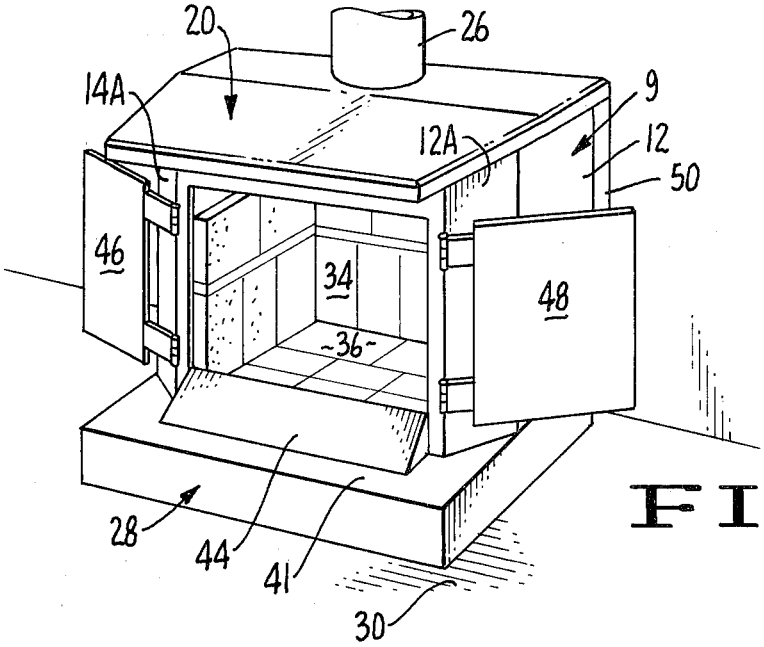
FIG. 1 is a perspective view of a free standing fireplace stove embodying the present invention.

Referring now to the drawings by reference characters, the stove of the present invention includes a sheet metal shell generally designated 9, having a back member 10 and side members 12 and 14. The side members taper inwardly as at 12A and 14A, and are connected to the front member 16. Front member 16 has an opening 18 of suitable size forming the mouth of the fireplace. Mounted over the top of the fireplace are the outer top cover 20, the inner top cover 22, and the flame deflector 24. The outer top cover 20 is provided with a connection 26 for the attachment of a conventional stove pipe.

The shell 9 is welded to a sheet metal base 28 which is described in detail later on. The base 28 can rest directly on a floor 30, and in case of a mobile home, an air vent 32 is provided directly under the base of the entrance of combustion air.

The interior of the body 9 has a firebrick lining 34 on the sides and back and a firebrick hearth 36 on the bottom. The base 28 includes an intermediate plate 38 with perforations 40 near the back of the fireplace. Base 28 has a solid top 41 with a single opening 42 therein. The bottom of the base 28 is open as is shown at 43. Mobile homes ordinarily are built with such a tight structure that there is insufficient combustion air so that in mobile home installations, it is normal to provide an intake air vent 32 directly under the fireplace stove.

The intermediate plate 38 forms a passage for air to flow to the front of the fireplace and enters the combustion zone through the opening 42 over which is mounted the deflector plate 44. Thus, cool air is drawn under the fireplace and passes substantially the entire depth of the fireplace before it enters the combustion zone. This, together with the firebrick 36 on the floor of the stove, provides a very cool exterior so that the base 28 can be set directly on a rug, wooden floor, or the like.

In mobile homes, it is necessary that the fireplace be capable of being completely closed, to obviate any danger from a spark or the like when the fireplace is unattended. Thus, preferably the structure of the present invention includes doors 46 and 48 which are hinged onto the members 14A and 12A, so that the fireplace can be completely closed off.

Figure 2:
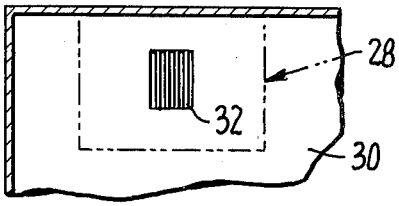
FIG. 2 is a diagrammatic view showing how the stove can be installed on a wall.
Figure 3:
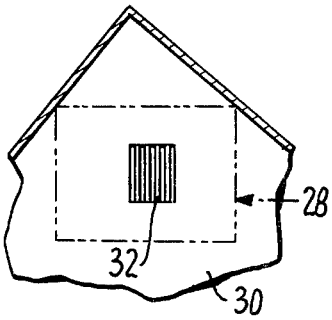
FIG. 3 shows how the fireplace stove of the present invention can be installed in a corner of a room.

Insulation 50 is provided at the back of the fireplace so that it is not necessary to provide any clearance in installing the fireplace and the back can be placed against a wall as is shown in FIG. 2. Alternatively, the corners can be placed against the walls as is shown in FIG. 3 for a corner mounted fireplace.

The base member 28 is provided with a removable plate 52 at the rear thereof, so that if the fireplace unit is installed in a conventional house, it is not necessary to employ the vent 32. Instead, the plate is removed as is shown in the partial view of FIG. 7 so that air can enter from the rear through the passage 54 as well as 56 and 40.

Figure 4:
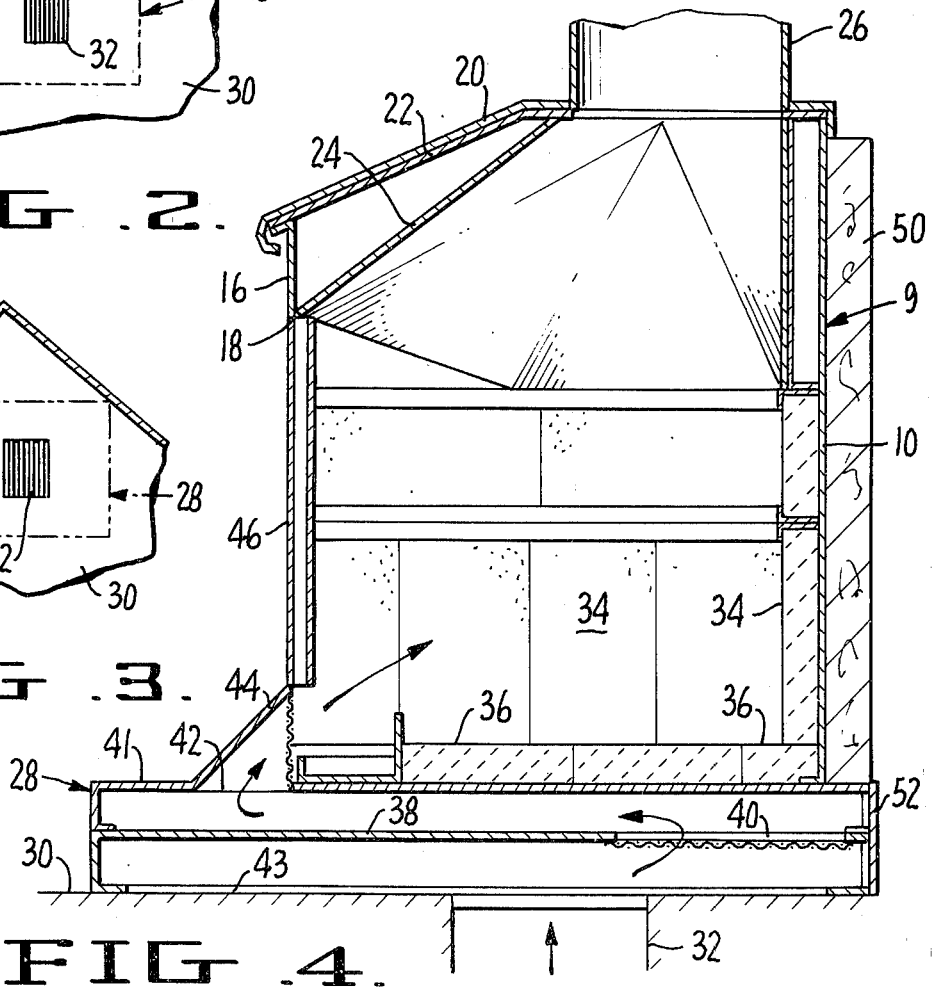
FIG. 4 is a side section of the stove of the present invention.

It will be seen, particularly with reference to FIG. 4, that the bottom of the fireplace is well insulated. In the case of the floor installation utilizing the vent 32, air is drawn under the intermediate plate 38 and travels the entire depth of the fireplace before entering the combustion zone. In either case, if the doors 46 and 48 are open, a portion of the combustion air will enter through the mouth of the fireplace but there will nevertheless be sufficient combustion air drawn through the base to keep it cool. Of course, if the doors are closed, substantially all of the combustion air will be drawn through the base. Thus, a versatile installation is provided so that it can be installed either in a permanent dwelling or in a mobile home and can comply with fire regulations, yet no insulation is required under the fireplace unit so it can be installed without any special precautions. Also, because of the insulation 50 provided at the back of the unit, the unit can be installed flush against the wall without creating a fire hazard.

I claim:

1. A free standing fireplace stove having a front and a back with a mouth in the front for supplying fuel to the stove, and having in combination:

a. a base for said fireplace stove, said base extending forward beyond the mouth of said fireplace and having an open passage for air therein;

b. an outlet for combustion air leading from said passage in said base to the front of said fireplace said passage extending completely across the mouth; and c. an air inlet adjacent the rear of said base whereby combustion air for said fireplace enters the rear of the base, passes completely under the fireplace, the enters the fireplace stove as combustion air through said outlet.

2. The structure of claim 1 wherein said fireplace has closeable doors over the mouth of said fireplace, whereby substantially all combustion air must pass through said base.

3. The structure of claim 1 wherein said base has an intermediate plate dividing the space within said base in two horizontal zones, namely an upper zone and a lower zone, the lower of said zones being open on its bottom side only and a passage at the rear of said fireplace in said intermediate place connecting the lower zone with the upper zone.

4. The structure of claim 1 wherein said base has a removable plate at the back thereof.

5. The structure of claim 1 having a layer of insulation on the back of the stove.

* * * * *